US006927690B2

(12) United States Patent
Wilson

(10) Patent No.: US 6,927,690 B2
(45) Date of Patent: Aug. 9, 2005

(54) METHOD AND APPARATUS FOR DETERMINING WHEN A DOOR HAS OPENED

(75) Inventor: Edwin P. Wilson, Pittsburgh, PA (US)

(73) Assignee: Minatronics Corporation, Pittsburgh, PA (US)

( * ) Notice: Subject to any disclaimer, the term of this patent is extended or adjusted under 35 U.S.C. 154(b) by 41 days.

(21) Appl. No.: 10/339,930

(22) Filed: Jan. 10, 2003

(65) Prior Publication Data

US 2004/0136642 A1 Jul. 15, 2004

(51) Int. Cl.[7] ..... G08B 13/08; G08B 21/00

(52) U.S. Cl. ..... 340/545.3; 340/686.2; 385/147

(58) Field of Search ..... 385/15, 16–18, 385/52; 340/524, 545, 555, 556

(56) References Cited

U.S. PATENT DOCUMENTS 4,812,810 A * 3/1989 Query et al. ..... 340/545.3
5,870,518 A * 2/1999 Haake et al. ..... 385/90

* cited by examiner

*Primary Examiner*—Frank G. Font
*Assistant Examiner*—Erin D. Chiem
(74) *Attorney, Agent, or Firm*—Ansel M. Schwartz

(57) ABSTRACT

An apparatus for determining when a door connected to a wall has opened. The apparatus includes a mechanism for transmitting an optical signal from a first point to a second point. The apparatus includes a mechanism for interrupting the signal from reaching the second point from the first point when the door is open. The interrupting mechanism contacting the transmitting means. A method for determining when a door has opened. An apparatus for interrupting an optical signal transmitted from a first point to a second point through a first fiber and at least a second fiber when a door is opened.

5 Claims, 4 Drawing Sheets

METHOD AND APPARATUS FOR DETERMINING WHEN A DOOR HAS OPENED

FIELD OF THE INVENTION

The present invention relates to an optical security apparatus for determining when a door connected to a wall has opened. More specifically, the present invention relates to an optical security apparatus for determining when a door connected to a wall has opened by breaking an optical path when the door is opened.

BACKGROUND OF THE INVENTION

As with other applications of fiber optic systems, it is essential that the system not be easily compromised, as can wired systems where an intruder need only pass a pin through two copper conductors to bypass the magnetic switch which is installed on a protected door. The fiber optic system uses a pulsed beam of light through a fiber optic cable which is nearly impossible to compromise. A fiber optic cable which is immune to water, salt, electronic fields, chlorine, and most nuclear radiation, etc. can easily be buried underground and/or can be routed through various means to the door where monitoring is required. The fiber optic system can be used to monitor all types of canisters of toxic chemicals as well as all types of indoor and outdoor equipment.

Due to the threat of terrorist activity lately, there is a need to monitor or protect hatches such as those which water treatment facilities use as access to their water storage tanks. Many of these hatches are located over water storage tanks where water is stored after being treated by the water treating facility, and the water goes from these tanks directly to the local homes and businesses, etc. Since many of these hatches are located in outdoor locations, they are subject to all kinds of weather including snow, high temperature sunshine, etc. The present invention provides a method of installing a, "Cable Security Apparatus", underneath the hatch in such a way that the fiber cable is not exposed above the hatch to an authorized or unauthorized individual who wants access. The person may be using a snow shovel to clear off the hatch door, (which would most likely inadvertently cut the fiber cable). The present method also provides a way that an authorized person, who needs to open the hatch, does not have to pull apart a fiber optic splice point when he opens the hatch. In fact the present system is automatic. When someone opens the hatch, the present hinged Cable Security Apparatus Fiber Optic loop splice point is opened and when he closes the hatch the hinged Cable Security Apparatus splice point loop is again closed.

The present invention also enables someone to install the assembly without having to get under the hatch, where generally there is no light when the hatch is closed. The installer needs only to open the hatch and while standing beside the hatch, can completely install the assembly without having to get down into the opening. This also avoids having the installer stand on the ladder under the hatch, and trying to work with a flashlight while working over his head with small parts, thereby avoiding dropping himself, flashlight, tools, screws and/or parts, etc. into the water below.

The preferred method of the present invention also eliminates having screws protrude up through the hatch which, after installation is completed, might be possible danger points for someone to cut themselves on if they were playing or working in the area above the hatch door.

SUMMARY OF THE INVENTION

The present invention pertains to an apparatus for determining when a door connected to a wall has opened. The apparatus comprises means for transmitting an optical signal from a first point to a second point. The apparatus comprises means for interrupting the signal from reaching the second point from the first point when the door is open. The interrupting means contacting the transmitting means.

The present invention pertains to a method for determining when a door has opened. The method comprises the steps of transmitting an optical signal from a first point to a second point when the door is closed. There is the step of interrupting the signal from reaching the second point from the first point when the door is open.

The present invention pertains to an apparatus for interrupting an optical signal transmitted from a first point to a second point through a first fiber and at least a second fiber when a door is opened. The apparatus comprises a first optical fiber holder for holding the first optical fiber. The apparatus comprises a second optical fiber holder for holding the second optical fiber and disposed adjacent to the first optical fiber so the first fiber and the second fiber are in alignment and the signal can be transmitted from the first point to the second point through the first fiber and the second fiber. The second fiber holder having a forcing mechanism that moves the second fiber out of alignment with the first fiber when the door is open. The apparatus comprises a block 30 which pushes against the second fiber holder and the forcing mechanism so the second holder maintains the second fiber in alignment with the first fiber held by the first fiber holder and releases the forcing mechanism when the door is open so the first fiber and the second fiber are out of alignment.

BRIEF DESCRIPTION OF THE DRAWINGS

In the accompanying drawings, the preferred embodiment of the invention and preferred methods of practicing the invention are illustrated in which.

DETAILED DESCRIPTION

Figure 1:
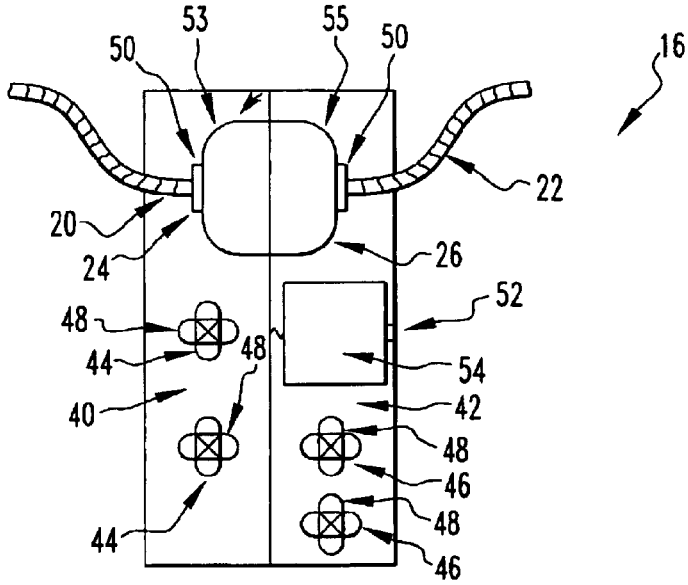
FIG. 1 is a front view of the apparatus (not to scale).
Figure 3:
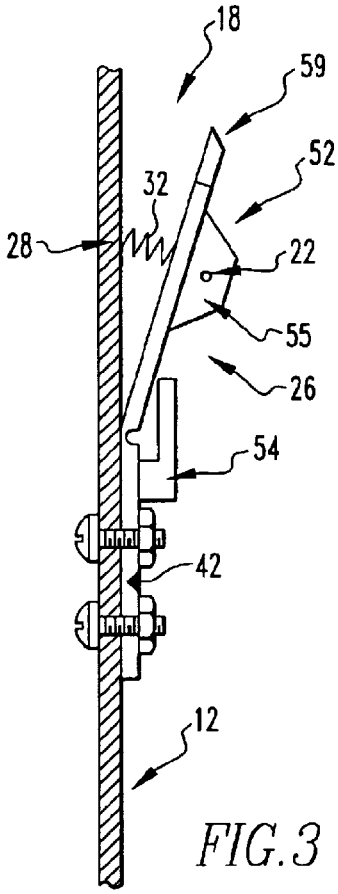
FIG. 3 is a side view of the second fiber holder.
Figure 6:
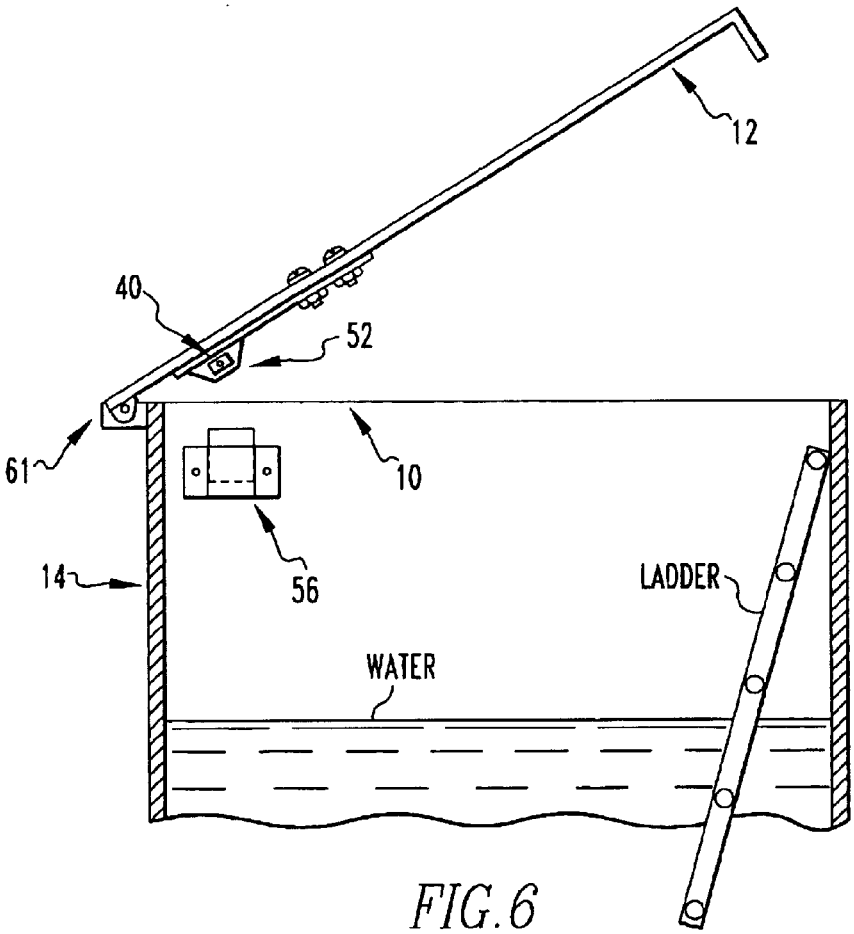
FIG. 6 is a view of the hatch door in the open position.

Referring now to the drawings wherein like reference numerals refer to similar or identical parts throughout the several views, and more specifically to FIGS. 1, 3 and 6 thereof, there is shown an apparatus 10 for determining when a door 12 connected to a wall 14 has opened. The apparatus 10 comprises means 16 for transmitting an optical signal from a first point to a second point. The apparatus 10 comprises means 18 for interrupting the signal from reaching the second point from the first point when the door 12 is open. The interrupting means 18 contacting the transmitting means 16.

Preferably, the transmitting means 16 includes a first optical fiber 20 and at least a second optical fiber 22 through which the signal is transmitted when the first fiber and the second fiber are in alignment, and through which the signal is unable to be transmitted to the second point from the first point when the first fiber and the second fiber are not in alignment. The interrupting means 18 causes the first fiber and the second fiber not to be in alignment when the door 12 is open, and to be in alignment when the door 12 is closed.

The interrupting means 18 preferably includes a first optical fiber holder 24 for holding the first optical fiber 20 and a second optical fiber holder 26 for holding the second optical fiber 22. The first optical fiber holder 24 positioned next to the second optical fiber holder 26 so when the door 12 is closed, the first fiber holder and the second fiber holder maintains the first fiber and the second fiber in alignment through which the signal is transmitted. The second fiber holder having a forcing mechanism 28 which moves the second fiber holder so the first fiber and the second fiber are out of alignment when the door 12 is open. The first fiber holder 24 preferably includes a first strip 40 and a first grip 53; and the second fiber holder 26 preferably includes the second strip 42, a second grip 55, and a hinge 52.

Preferably, the interrupting means 18 includes a block 30 which pushes against the second fiber holder and the forcing mechanism 28 so the second fiber holder maintains the second fiber in alignment with the first fiber held by the first fiber holder and releases the forcing mechanism 28 when the door 12 is open so the first fiber and the second fiber are out of alignment. The forcing mechanism 28 is preferably a spring 32. The first fiber holder and the second fiber holder are attached to the door 12, and the block 30 is attached to the wall 14. The light signal and the first and second fibers arise from and are connected to the first point and the second point of the LightGard optical security system sold by Minatronics Corporation, Pittsburgh, Pa. The first and second fibers would extend through a hole drilled in the wall or door to the security system.

The present invention pertains to a method for determining when a door 12 has opened. The method comprises the steps of transmitting an optical signal from a first point to a second point when the door 12 is closed. There is the step of interrupting the signal from reaching the second point from the first point when the door 12 is open.

Preferably, the transmitting step includes the step of transmitting the signal from the first point to the second point through a first optical fiber 20 and at least a second optical fiber 22. The interrupting step preferably includes the step of moving the second optical fiber 22 out of alignment with the first optical fiber 20 when the door 12 is open. Preferably, after the moving step, there is the step of putting the second fiber into alignment with the first fiber when the door 12 is closed.

The moving step preferably includes the step of moving the second optical fiber 22 that is held by a second optical fiber holder 26 out of alignment with the first optical fiber 20 that is held by the first optical fiber holder 24. Preferably, the putting step includes the step of causing the second fiber to align with the first fiber by pushing a block 30 against the second fiber holder when the door 12 closes. The moving step preferably includes the step of expanding a spring 32 of the second fiber holder which moves the second fiber holder and places the second fiber out of alignment with the first fiber held by the first fiber holder.

The present invention pertains to an apparatus 10 for interrupting an optical signal transmitted from a first point to a second point through a first fiber and at least a second fiber when a door 12 is opened. The apparatus 10 comprises a first optical fiber holder 24 for holding the first optical fiber 20. The apparatus 10 comprises a second optical fiber holder 26 for holding the second optical fiber 22 and disposed adjacent to the first optical fiber 20 so the first fiber and the second fiber are in alignment and the signal can be transmitted from the first point to the second point through the first fiber and the second fiber. The second fiber holder having a forcing mechanism 28 that moves the second fiber out of alignment with the first fiber when the door 12 is open. The apparatus 10 comprises a block 30 which pushes against the second fiber holder and the forcing mechanism 28 so the second holder maintains the second fiber in alignment with the first fiber held by the first fiber holder and releases the forcing mechanism 28 when the door 12 is open so the first fiber and the second fiber are out of alignment. Preferably, the forcing mechanism 28 is a spring 32.

In the operation of the invention, the installation only requires the drilling of four holes in the door of a hatch and using a simple alignment procedure to adjust the apparatus so that it is properly aligned. A rubbery fairly firm pad or block is then installed on a side panel of the hatch so that as the hatch is closed, the spring loaded side of the apparatus is depressed to the closed position by the constant pressure of the block. Proper alignment of the apparatus is assured by the flat surface of the hatch door against which the stationery half of the apparatus is already mounted, and against which the spring loaded half is pressed.

The strip 40 of metal or plastic, to which the stationery half of the apparatus is "Super Glued", has two slotted vertical mounting holes 44 for vertical adjustment. The other metal or plastic strip 42, which has the spring loaded side, and to which the other half of the apparatus is "Super Glued", has two horizontal slotted mounting holes 46. This enables it to be adjusted next to the first half so that the two strips can be positioned so that they are in close proximity to each other, and can also be vertically adjusted so that the first optical fiber and the second optical fiber are in proper position for the pulsed beam of light to pass through. This alignment procedure can be facilitated by passing a piece of fiber optic cable through the two halves of the apparatus when it is in the closed position as suggested by U.S. Pat. No. 5,289,559, incorporated by reference herein. The four mounting screws 48 are then tightened so as to maintain the proper alignment of the apparatus when it is in the closed position. The alignment fiber cable is then removed and the Mini-DNP fiber optic connectors 50 are then snapped into the cavities 60 on the opposite sides of the respective strips 40, 42.

Having the rubbery material of the block 30 of a nature that does not absorb water helps keep the apparatus relatively free from the condensation moisture that is commonly found under the hatch door. The condensation will form on the hatch door and on the underneath side of the rubbery material, but the amount of condensation behind the spring loaded portion of the apparatus is negligible. This will mean that the likelihood of the spring loaded portion being frozen closed during cold weather is very unlikely.

The spring used to force the hinged portion 52 of the apparatus open will be quite strong in order to be sure that the hinge 52 moves to the open position when the hatch door is opened. A stop 54 is provided on the hinge 52 so that the hinge 52 can only open enough so that the light beam passing through the grips 53, 55 will be broken. However, the hinged portion 52 will only open slightly so that it will be in proper position to close again as the block presses against it as the hatch door closes.

The rubber material of the block is preferably of a nature that it does not acquire a permanent depression when in the closed position, and will retain its flexibility. The bracket 56 that is used to hold the block to the side of the hatch preferably will also be adjustable and will be one that will hold despite great variations in temperature. It should be able to withstand the high temperature that will be experienced when the sun is beating down on the hatch cover in the summer as well as the extreme cold temperature of winter nights.

Figure 5:
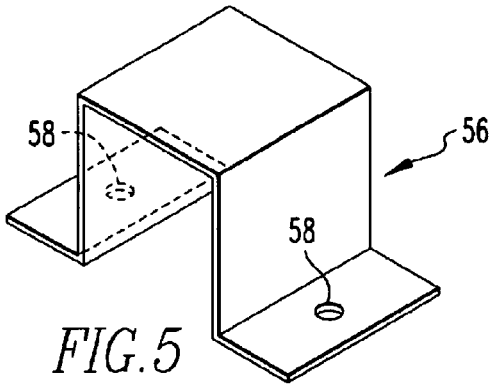
FIG. 5 is a side view of a metal mounting bracket.

In lieu of gluing the block to the side of the hatch, the bracket 56 with slotted mounting holes 58 can be mounted using two "lag" type bolts with lock washers and nuts or sheet metal screws which are inserted through two holes that are drilled through the side of the hatch as well as provided in the bracket 56, as shown in FIGS. 5 and 6. If the sides of the bracket are slightly shorter than the size of the block, tightening of the mounting screws will hold the block in its properly adjusted position thereby eliminating the need for adjustable mounting holes for the rubber block.

Although the above description explains the installation procedure and parts required for installing a fiber optic security system with hatch switch for monitoring a hatch cover used by water treatment facilities, anyone experienced in the technology can adapt the same system with minor modifications to protect doors and openings of all kinds as well as even fence doors.

The apparatus is designed to be easily installed on typical hatch doors that are used by Water Treatment Facilities and other industrial plants. The apparatus is designed to monitor the opening and closing of these doors by authorized or unauthorized individuals. The pulsed beam of light of the LightGard Security System and the fiber optic cable and switch can not be easily compromised as can conventional wired Security Systems and the magnetic switches that many of them use. The parts are also designed to be used in hazardous environments where caustic chemicals or explosives are used.

The apparatus can generally be installed without the installer having to get physically down inside the hatch. It also provides a totally safe switch for installation in all sorts of hazardous and/or explosive environments.

The design of the apparatus facilitates easy alignment of the two halves of the optical switch, and the built in spring stop 54, and beveled edge 59 assures the breaking of the optical beam of light when the hatch door is opened, and also assures that the hinged side will be in proper position to be depressed when the hatch door closes. The beveled edge 59 facilitates the rubber block 30 to slide past the second grip 55 as hatch door 12 closes.

To install the apparatus simply drill four clearance holes, in the door of the hatch, for the four stainless steel 8/32 machine screws using the two plastic portions of the apparatus as a template. The strips 40, 42 should be positioned on the underneath side of the door, as near to the hatch door's hinge 61 side as possible. The switch portion of the apparatus should be positioned so as to be pointing towards the door's hinge, and situated so that it is over the block of the bracket 56. The bracket 56 and block are to be positioned on the side wall of the hatch near the top of the hinged side of the hatch's side wall. The metal portion of the bracket 56 should be positioned and the rubber block extended enough so that the rubber block is approximately ⅜" (⅜ inch) from the underneath surface of the hatch door when the door is in its closed position. This will assure that the strip 40, 42, which is 7/16 inch high in its closed position, will have the spring 32 completely depressed, thus causing the two strips 40, 42 of the apparatus to be in proper alignment when the hatch door closes.

The bracket 56 should be used as a template to locate the two clearance holes for the #8 machine screws that mount the bracket 56 to the side wall of the hatch. The two stainless steel #8×½ or ¾ inch screws should be inserted through the wall of the hatch from the outside of the hatch so that they engage the two provided holes in the metal bracket and firmly hold the metal bracket in place. The metal bracket has been designed to firmly hold the rubber block in position when the two mounting screws are tightened.

It is suggested that the strips 40, 42 of the apparatus be positioned first. The rounded portion of the switch should not be more than one inch from the inside surface of the hatch wall when the hatch door is in the closed position. If this is not possible, then a spacer will have to be used to move the metal bracket out to a position where it will be located directly under the hinge 52 when the hatch door closes. After the strips 40, 42 of the apparatus is properly installed, be sure that the hatch door can be lowered to its closed position. Then drill the remaining two holes and install the strips 40, 42. Be sure that the strips 40, 42 are properly aligned. This can be done by depressing the hinge 52 of the apparatus and passing a piece of the fiber cable through the two strips. In the closed position, the sloping sides of the two strips 40, 42 should be smooth to the feel and the two pieces should be butted closely up against each other.

If it is desirable for the apparatus to be mounted on the side wall of the hatch and to have the hatch door itself depress the apparatus as it closes, this can be easily accomplished. The two portions of the apparatus can be mounted on a plastic or metal angle bracket that is then mounted to the side of the hatch's wall. The angle bracket must be large enough to hold the two plastic parts and the fiber cable connectors. The portion of the angle bracket that is mounted to the side of the hatch's wall should have slotted holes to allow it to be properly adjusted to the proper height under the hatch door.

The final step is to gently snap the two fiber optic plugs 50 that have been attached to the first and second optical fibers into place. Do not force the plugs into place. They easily snap into place when they are properly oriented.

FIG. 1 is a front view of the apparatus with the various parts indicated (not to scale).

24 This is either a metal or plastic part to which the grip 53 is "Super Glued". It has vertical mounting slots 44 for mounting screws to go through.

26 The other half of a metal or plastic part that has two horizontal mounting slots 46 through which mounting screws go through. It has a stop 54, grip 55 and hinge 52.

52 The moving part of 42 which the grip 55 is "Super Glued". It has the spring 32 which is on the underneath side. The spring 32 is installed in such a way as to cause hinge 52 to move away from the mounting surface when the rubber block 30 is not pressing against it.

53,55 The two halves of the system explained in U.S. Pat. No. 5,289,559, incorporated by reference herein.

Figure 8:
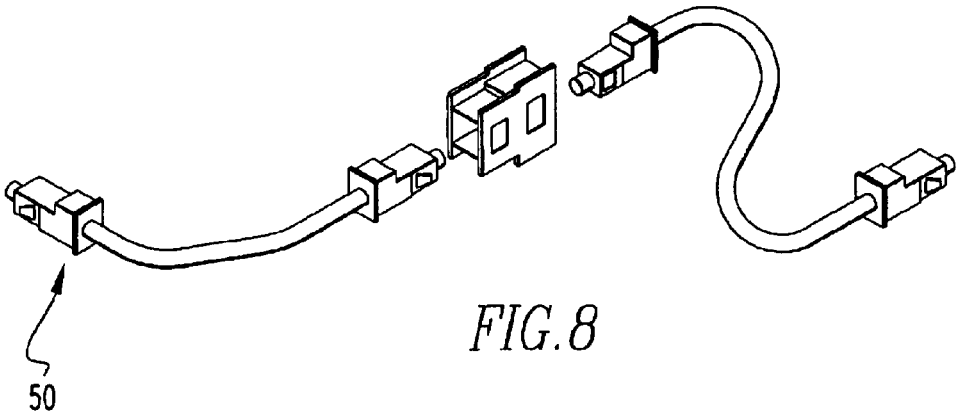
FIG. 8 shows mini-DNP connectors and a fiber optic cable by AMP/TYCO.

50 Mini-DNP connectors by AMP/TYCO (see FIG. 8).

20,22 Typical fiber optic cables by AMP/TYCO (see FIG. 8).

54 A mechanical stop that is made as part of the assembly so that it stops the hinge 52 from opening too far.

Figure 2:
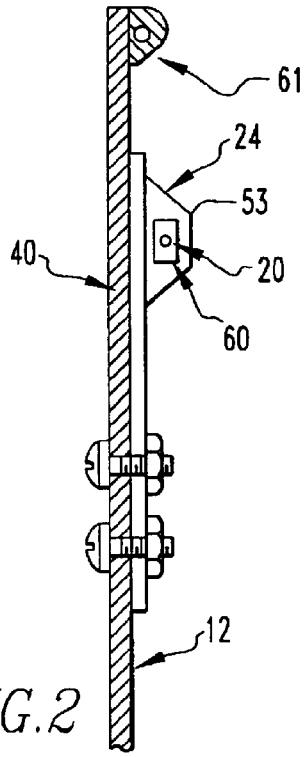
FIG. 2 is a side view of the first fiber holder.

FIG. 2 is a side view of the first fiber holder 24.

60 A cavity in the grip 53 that is filled by 50 when it is inserted.

12 The hatch door.

61 The hatch door hinge.

FIG. 3 is a side view of the second fiber holder.

54 The stop that prevents the hinge 52 from opening too far.

52 The hinge.

32 The spring that moves hinge 52 when the rubber block 30 is not pressing on hinge 52.

Figure 4:
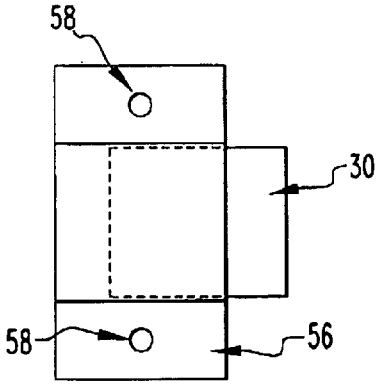
FIG. 4 is a top view of metal bracket shown with a rubber block in an extended position.

FIG. 4 is a top view of metal bracket 56 shown with rubber block 30 in an extended position.

FIG. 5 is a side view of metal mounting bracket 56. The sides of the metal bracket 56 are slightly shorter than the sides of the rubber block 30 so that when the mounting screws pull the metal bracket 56 close to the mounting surface, the rubber block 30 will be compressed and held in proper position to depress the hinge 52 when the hatch door 12 closes.

FIG. 6 is a picture of the hatch door in the open position.

Figure 7:
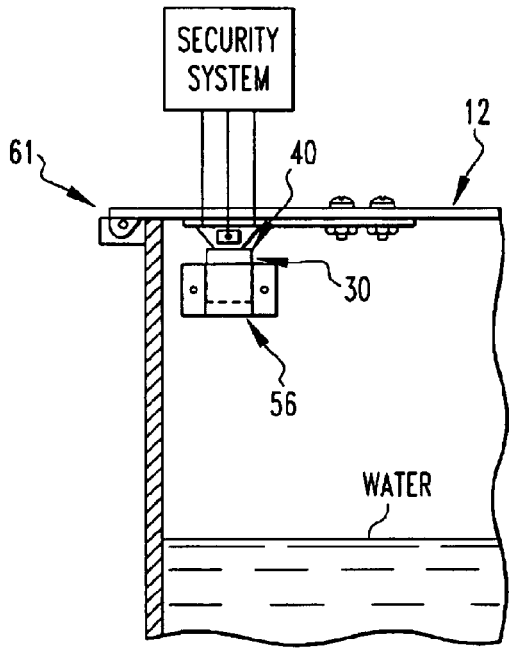
FIG. 7 is a view of the hatch door in the closed position.

FIG. 7 is a picture of the hatch door in the closed position. Hinge 52 is pressed by block 30 to the closed position as spring 32 is compressed. Light can pass through the first and second fibers since they are now aligned with each other.

FIG. 8 shows mini-DNP connectors 50 and a fiber optic cable by AMP/TYCO.

Although the invention has been described in detail in the foregoing embodiments for the purpose of illustration, it is to be understood that such detail is solely for that purpose and that variations can be made therein by those skilled in the art without departing from the spirit and scope of the invention except as it may be described by the following claims.

What is claimed is:

1. An apparatus for determining when a door connected to a wall has opened comprising:

means for transmitting an optical signal from a first point to a second point, the transmitting means includes a-first optical fiber and at least a-second optical fiber through which the signal is transmitted when the first fiber and the second fiber are in alignment, and through which the signal is unable to be transmitted to the second point from the first point when the first fiber and the second fiber are not in alignment; and means for interrupting the signal from reaching the second point from the first point when the door is opened, the interrupting means contacting the transmitting means, the interrupting means causing the first fiber and the second fiber not to be in alignment when the door is opened, and to be in alignment when the door is closed, the interrupting means includes a block, first optical fiber holder for holding the first optical fiber and a second optical fiber holder for holding the second optical fiber, the first fiber holder positioned next to the second fiber holder so when the door is closed, the first fiber holder and the second fiber holder maintains the first fiber and the second fiber in alignment through which the signal is transmitted, the first fiber holder having a forcing mechanism which moves the first fiber holder so the first fiber and the second fiber are out of alignment when the door is opened.

2. An apparatus as described in claim 1 wherein the interrupting means includes a block which pushes against the first holder and the forcing mechanism so the first fiber holder maintains the first fiber in alignment with the second fiber held by the second fiber holder and releases the forcing mechanism when the door is open so the first fiber and the second fiber are out of alignment.

3. An apparatus as described in claim 2 wherein the forcing mechanism is a spring, the first fiber holder and the second fiber holder are attached to the door, and the block is attached to the wall.

4. A method for determining when a door has opened comprising the steps of:

transmitting an optical signal from a first point to a second point through a first optical fiber and at least a second optical fiber when the door is closed;

interrupting the signal from reaching the second point from the first point when the door is open by moving the first optical fiber that is held by a first optical fiber holder out of alignment with the second optical fiber that is held by the second optical fiber holder when the door is open; and putting the first fiber into alignment with the second fiber when the door is closed, by causing the first fiber to align with the second fiber by pushing a block against the first fiber holder when the door closes.

5. A method as described in claim 4 wherein the moving step includes the step of expanding a spring of the first fiber holder which moves the first fiber holder and places the first fiber out of alignment with the second fiber held by the second fiber holder.

* * * * *